US006192627B1

(12) United States Patent
Gompertz et al.

(10) Patent No.: US 6,192,627 B1
(45) Date of Patent: Feb. 27, 2001

(54) LEAD SCREW BARRIER SYSTEM

(75) Inventors: Michael A. Gompertz, Orinda; Arthur B. Dawson, San Ramon; Klaus Silbermann, Sunol, all of CA (US)

(73) Assignee: IJOT Development Inc., Oakland, CA (US)

( * ) Notice: Subject to any disclaimer, the term of this patent is extended or adjusted under 35 U.S.C. 154(b) by 0 days.

(21) Appl. No.: 09/442,581

(22) Filed: Nov. 18, 1999

(51) Int. Cl.[7] ..... E01F 13/00
(52) U.S. Cl. ..... 49/34; 160/330
(58) Field of Search ..... 49/34, 131, 132, 49/133; 160/330, 332, 329

(56) References Cited

U.S. PATENT DOCUMENTS

| | | | |
|---|---|---|---|
| 334,801 | 1/1886 | Parrish . | |
| 760,030 | 5/1904 | Smith . | |
| 923,494 | 6/1909 | Cummings . | |
| 1,468,471 | 9/1923 | Harsen . | |
| 1,481,044 | 1/1924 | Ware . | |
| 1,529,744 | 3/1925 | Keenan . | |
| 1,642,875 | 9/1927 | Fitch et al. . | |
| 1,643,297 | 9/1927 | Fitch et al. . | |
| 1,665,157 | 4/1928 | Dahnke . | |
| 1,790,304 | 1/1931 | House . | |
| 1,987,913 | 1/1935 | Schulz | 292/264 |
| 2,170,467 | 8/1939 | Anderson | 246/126 |
| 2,298,115 | 10/1942 | Felton et al. | 24/68 |
| 2,527,866 | 10/1950 | Welch | 296/57 |
| 2,605,829 | 8/1952 | Sawyer | 160/328 |
| 2,662,571 | 12/1953 | Kessler | 151/41.76 |
| 2,663,103 * | 12/1953 | Ellison | 49/34 |
| 2,827,265 | 3/1958 | McKillop | 256/41 |
| 2,919,895 | 1/1960 | Johnson | 254/78 |
| 3,022,590 | 2/1962 | Ohlhausen | 39/5 |
| 3,893,724 | 7/1975 | Reinfeld | 292/247 |
| 4,108,405 | 8/1978 | Gibson | 246/125 |
| 4,151,900 | 5/1979 | Kirwan | 188/174 |
| 4,174,119 | 11/1979 | Biles | 280/179 |
| 4,333,268 * | 6/1982 | Dumbeck | 49/34 |
| 4,509,577 | 4/1985 | Priefert | 160/328 |
| 4,553,739 | 11/1985 | Baines | 256/23 |
| 5,245,787 * | 9/1993 | Swenson et al. | 49/34 |
| 5,452,542 | 9/1995 | Bardwell | 49/34 |
| 5,537,778 * | 7/1996 | Bardwell et al. | 49/34 |
| 5,871,038 | 2/1999 | Gompertz et al. | 160/328 |
| 6,035,921 * | 3/2000 | Minow | 49/34 X |

FOREIGN PATENT DOCUMENTS

| | | | |
|---|---|---|---|
| 2239476 * | 7/1991 | (GB) | 49/34 |
| 4025683 * | 11/1994 | (WO) | 49/34 |

* cited by examiner

*Primary Examiner*—Jerry Redman
(74) *Attorney, Agent, or Firm*—Medlen & Carroll, LLP

(57) ABSTRACT

A flexible barrier system is described that can be lowered or raised from a remote location using an accompanying remote control device which is either lockable or not lockable. The motor and mechanics used to raise and lower the chain are modular for easy repair and replacement, and enclosed in a protective covering in order to protect them from damage or tampering.

21 Claims, 8 Drawing Sheets

LEAD SCREW BARRIER SYSTEM

FIELD OF THE INVENTION

This invention relates to the field of gates and mechanical barriers which prevent passage through an opening. More specifically, this invention relates to the field of gates and mechanical barriers which are opened and closed by electric motors.

BACKGROUND OF THE INVENTION

A chain gate generally stretches across a driveway, road or passageway in order to block the travel of unwanted persons or vehicular traffic onto that driveway, road or passageway. The gate is usually attached to one post on either side of the driveway or road and stretched across and hooked, and/or locked to a post on the other side of the driveway or road. In the past the chain has been stretched across the driveway manually. A person who wanted to drive their vehicle through the chain gate or a gate-like barrier would have to get out of their vehicle, unhook the chain from the fence post or gate and then drive through the gate posts or opening. To close the chain gate or gate-like barrier, the person would again have to get out of their vehicle and hook the chain back up to the post. During inclimate weather this procedure can be very demanding as a person wishing to travel through the chain gate or gate-like barrier will be exposed to the bad weather conditions both in opening and closing the gate.

An early gate of this form is presented by J. S. Fitch et al. in U.S. Pat. No. 1,643,297. The gate structure 10 as disclosed by this patent is fixedly connected to the gate post 11. This gate structure is lowered and raised manually by pulling the cable 35 which releases and engages the arm 22 with the hook 24. When the gate structure is lowered it rests on the ground between the posts so that a vehicle driving through the gate will drive over the chain.

Another gate locking device of this type is presented by Reinfeld in U.S. Pat. No. 3,893,724. The gate 4 is connected between the stationary fence post 26 and the movable fence post 24. The movable fence post 24 is locked to another stationary fence post 2 by a locking device 1. The locking device has an arm 9 which has a flexible member 10 which connects over the top of the movable fence post 24 to lock the gate in the closed position. When the gate is opened, the flexible member 10 is manually unhooked from the top of the movable fence post 24, lifted out of the ring 28 and the gate structure is then carried to the opposite side of the road or driveway thus clearing the gate from the road or driveway. When the gate is to be closed, the gate structure has to be manually carried across the road or driveway, the bottom of the fence post 27 has to be slipped into the ring 28 at the bottom, the flexible member 10 is slipped over the top of the fence post 24 and the locking device 1 is then secured in the locked position.

A solar-powered electrically controlled gate is presented by Dumbeck in U.S. Pat. No. 4,333,268. The chain 10 is fixedly connected to the post 11 and is coupled to the pivoted lever 14 which is connected to the opposite post 12. The chain 10 is raised and lowered by the two pivoted levers 14,15 and the drive motor 16. The motor has a worm drive train 17 and a pivoting gear 18. The lever 15 is moved downward to relax the chain 10 and open the gate and the lever 15 is moved upward to tighten the chain 10 and close the gate. The operation of this gate is controlled by manual operation of the corresponding switch 42,43.

What is needed is a barrier system which can be mechanically opened and closed by a user with a remote control device so that the user will not have to get out of their vehicle at any time to open or close the gate and can also open or close the gate from a long distance away, thus giving a homeowner great protection or control, where the driveway may be a great distance from their home.

SUMMARY OF THE INVENTION

The mechanical barrier of the present invention has an electrically controlled mechanism. The barrier (e.g. chain gate) can be lowered or raised from a remote location using an accompanying remote control device. The motor and mechanics used to raise and lower the chain are modular for easy repair and replacement, and enclosed in a protective covering in order to protect them from damage or tampering. The motor can be operated by alternating current or direct current to provide the user with flexibility and allow the gate to be operated either by direct wire to an electrical source or by one or more batteries or recharging solar cells, and used in remote places where there is no access to electrical power.

In one embodiment, a motor turns a gear that turns another gear which is attached to and which drives a lead screw. As the lead screw turns it moves a nut up and down the lead screw. Attached to the nut is a roller around which a barrier (such as a chain) is captured and moves; depending upon the direction the lead screw is turning the nut chases up or down the screw thus releasing out or reeling in a length of chain or other such flexible tethers such as various designs of chain, rope, wire, etc. As this flexible tether moves in or our of the post, the flexible barrier likewise lowers to the extent of laying on the ground for passage or tightens to an upright position (i.e., raises) to prevent passage. Another embodiment has the motor connected "in-line" to a set of planetary or other gears connected directly to the lead screw shaft providing a "direct in-line" drive line power source. This approach reduces the need for additional mounting plates and parts and makes for a more efficient and a more simply designed product. Specifically, the "In-line" embodiment has the motor output shaft extended or connected directly to the gear box shaft. In this configuration, the motor output shaft functions as both the input and output shafts of the planetary gear box. The motor output shaft is both centered and concentrical to the motor and gear box, as opposed to the output shaft of the motor being offset from and separate from a parallel input/output shaft of the gear box.

In one embodiment, the present invention contemplates a barrier system comprising: a) a barrier linking a first stationary object to a second stationary object; b) means for raising and lowering said barrier, said means coupled to said barrier and comprising i) a lead screw, ii) a motor operably linked to said lead screw such that said lead screw turns when said motor operates, and iii) a mechanism chain traveling roller assembly configured such that it moves up and down said lead screw when said lead screw turns, said mechanism chain traveling roller assembly comprising an internal roller that engages said barrier.

The present invention also contemplates a barrier system comprising: a) a barrier linking a first stationary object to a second stationary object, b) a mechanism for raising and lowering said barrier, said mechanism enclosed within said first stationary object and coupled to said barrier, said mechanism comprising; i) a lead screw, ii) a motor operably linked to said lead screw such that said lead screw turns when said motor operates, and iii) a traveling roller assembly configured such that it moves up and down said lead screw when said lead screw turns, said traveling roller assembly comprising an internal roller that engages said barrier.

The present invention also contemplates a barrier system comprising: a) a barrier linking a first stationary object to a second stationary object, b) a barrier raising and lowering mechanism, said mechanism enclosed within said first stationary object and coupled to said barrier, said mechanism comprising; i) a lead screw, ii) a motor operably linked to said lead screw such that said lead screw turns when said motor operates, iii) a traveling roller assembly configured such that it moves up and down said lead screw when said lead screw turns, said traveling roller assembly comprising an internal roller that engages said barrier, and iv) a guide configured such that said roller assembly is prevented from turning when said lead screw turns, said guide slidably engaging said traveling roller assembly.

It is not intended that the present invention be limited to the specific nature of the barrier. In one embodiment, the barrier is a flexible barrier. Flexible barriers include but are not limited to chains, ropes, cables, flexible cyclone fencing, vinyl fabric (such as that used for the tail gates of pick-up trucks), where the barrier is a chain, either single chain, or a matrix of chains is contemplated.

In one embodiment, the barrier, such as a chain, is contemplated to make a chain net or chain matrix which hangs between said first stationary object and said second stationary object. Such a barrier structure may comprise a first horizontal bottom member coupled to both the first stationary object and the second stationary object at a ground level; a second horizontal top member coupled to the first stationary object, the second stationary object, and serving as the member for the means for mechanically raising and lowering the barrier; and a plurality of flexible members, horizontal and vertical, coupled between the first horizontal member and the second horizontal member, thus creating a net, to block a space between the first stationary object, the second stationary object, the first horizontal member, and the second horizontal member.

In one embodiment, the present invention contemplates a means for locking the barrier in a taut, raised position which will remain locked when weight or force is applied, said means for locking coupled to the means for mechanically raising and lowering the flexible barrier.

It is not intended that the present invention be limited to particular configurations of the elements of the barrier system. However, it is preferred that said means for raising and lowering said barrier is modular and is enclosed within said first stationary object. Of course, a variety of stationary objects can be used for this purpose, including but not limited to hollow posts (e.g. wooden posts, metal posts, square or round masonry posts, fence posts etc.), hollow pipes (aluminum pipes, steel pipes, cement pipes, etc.), hollow pillars, hollow columns and the like.

In a preferred embodiment, said lead screw has top and bottom ends, said bottom end secured to a base plate mounted within said post, said top plate and bottom plate being separated and connected by structural rods, the front two rods also serving as guide posts for the mechanism chain travelling roller assembly, and said mechanism chain traveling roller assembly slidably engages these guides, said guide configured such that said mechanism chain traveling roller assembly is prevented from turning when said lead screw turns. The guides can take many forms including but not limited to a column or pole.

In another preferred embodiment, the motor can reside outside the post with a shaft extending into the post (or pipe/pillar/hollow standpipe) supporting an axle supporting a pulley upon which a flexible barrier is raised when wound and lowered when the barrier being relaxed then allowing passage.

It is not intended that the present invention be limited to a particular motor. In one embodiment, said motor comprises an output shaft and said motor is operably linked to said lead screw through one or more gears engaging said output shaft. In some embodiments, the motor may be directly linked to the lead screw without use of gears, sprockets or the like while in other embodiments, offset gearing and sprockets may be used, or in-line sprockets and gears may be used. By linking the motor to said lead screw said lead screw turns when said motor operates. The motor can be operated by alternating current or direct current to provide the user with flexibility and allow the barrier to be operated either by direct wire to an electrical source or by one or more batteries or recharging solar cells, and used in remote places where there is no access to electrical power. In one embodiment, the motor is electrically powered by a direct wire linkage to an alternating current source. In another embodiment, the motor is electrically powered by a battery. In a preferred embodiment, the electrically operated barrier system can be operated by a user from a remote location using a remote-control device.

DETAILED DESCRIPTION

The operation of this chain gate invention is now described with reference to the figures. However, the figures are illustrative and not meant to limit the invention.

Figure 1A:
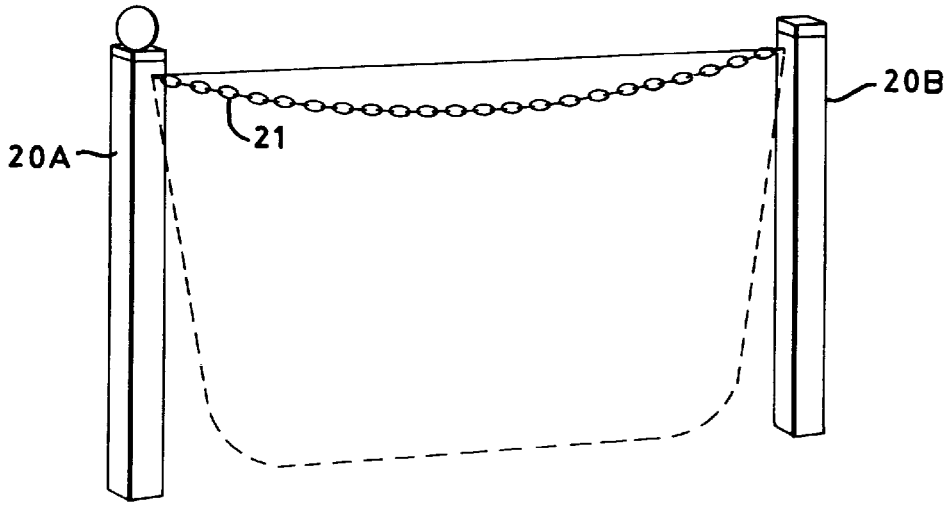
FIGS. 1A–C shows 3 examples of numerous barrier options possible for use with the present invention.
Figure 1B:
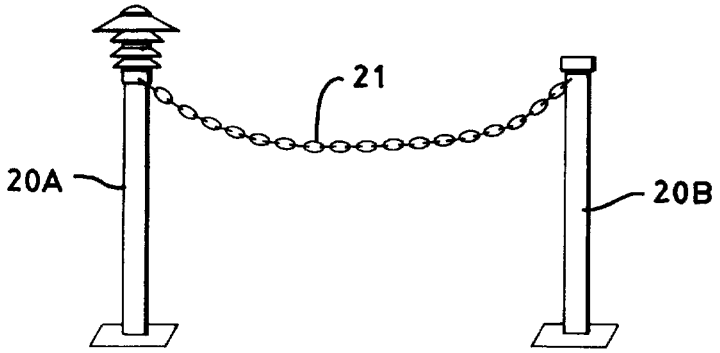
Figure 1C:
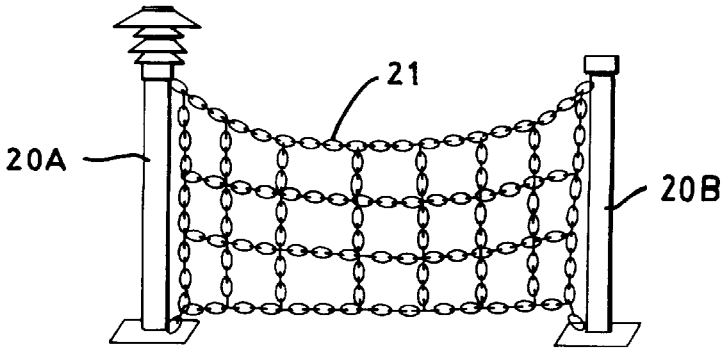
Figure 2B:
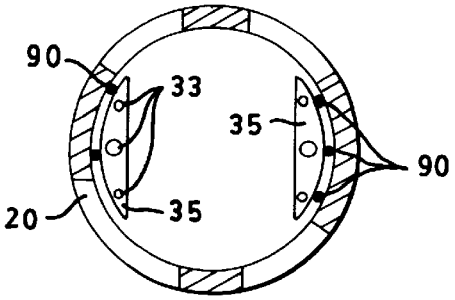
FIG. 2A shows a side and inside view of one embodiment of the barrier system of the present invention wherein the operating mechanism is inside a post. The chain is in-line with the chain anchor and with the traveling roller assembly and the motor is in-line with the lead screw. In addition, a top view is shown (FIG. 2B) of one embodiment of the mechanism assembly anchoring plate 35 secured to the posts by means of a number of tack welds 90 to which is attached the entire removable modular mechanism framework, to which the lead screw and all mechanisms are attached.
FIG. 2C shows a side and inside view of one embodiment using an offset motor and gearing system attached to the lead screw. The two are offset in the sense that one gear is attached to the motor shaft and concentric with the motor, which is offset (set aside and parallel to) from the center line of the lead screw to which is attached the other gear that is attached to and concentric with the lead screw.
FIG. 2D shows the top and inside view of one embodiment of FIG. 2C.
FIG. 2E is a top view of one embodiment of a mechanism frame base plate 43 showing a mechanism bottom plate locator pin (41).
FIG. 2F is a side view showing the mechanism bottom plate 40 and locator pin (41).
Figure 2D:
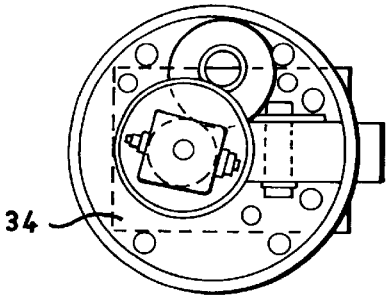
Figure 2A:
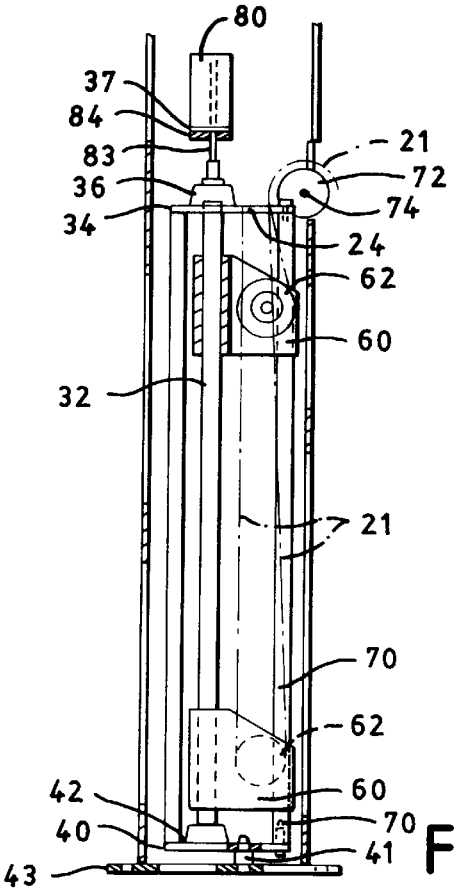
Figure 2C:
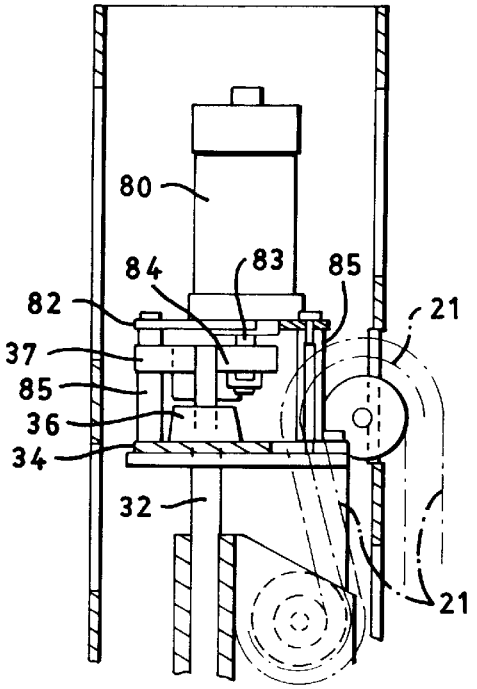
Figure 2E:
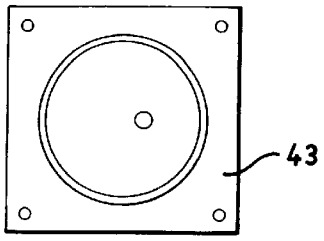
Figure 2F:
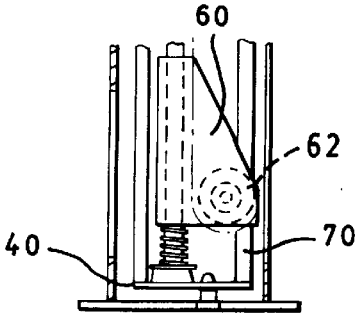

FIGS. 1A–C display three embodiments for a set of posts 20A & 20B that support a flexible barrier 21. One end of a top chain component 21 is secured to a stationary non-mechanized post, wall, building, or other structure (e.g., by means of padlock, bolt and nut or other first fastening means inside the post as the chain passes into the post) and the other end of the top chain component 21 is reeled in or out of the opposing post (FIG. 2A) by means of rolling over an external roller 72, itself comprising an axle 74, down the inside of the post over and around an internal roller 62 (FIGS. 2A, 2C, 2F, & 3A: part of a mechanism chain traveling roller assembly 60) and up to a securing anchor clamp bracket 24 (FIGS. 2A, 3D, & 5), or other second fastening means. As the mechanism chain traveling roller assembly 60 (FIGS. 3A & 3D) moves up and down a turning lead screw 32 (FIGS. 2A, 2C, 3A, & 3D) the internal roller 62 (FIGS. 3B & 3C) allows the chain 21 to be reeled in or reeled out according to the direction the lead screw 32 turns. The mechanism chain roller assembly 60 moves by means of the lead screw 32 turning inside the elongated threaded nut 61 (FIGS. 3D & 4A). The threaded nut 61 as part of the mechanism chain roller assembly 60 is prohibited from turning with the lead screw 32 because the mechanism chain traveling roller assembly 60 is constrained into a position along a singular vertical plane by means of two, or more, roller assembly guide posts 70 of which each one is located on each of the opposing sides of the mechanism chain traveling roller assembly 60 (FIGS. 2A, 2F, & 4A). The internal roller 62 (FIGS. 3A, 3B, & 3C) turns on a roller axle spacer 87 through which the axle 63 passes. (FIGS. 3B & 3C) This spacer serves the purpose of allowing the internal roller 62 to turn easily as the roller axle spacer 87 (FIGS. 3B, 3C, & 3D) holds apart the two side plates 64 (FIGS. 3A, 3D, 4A, & 4B) so that they do not compress against the sides of the internal roller 62. Additionally, there are two delrin roller guides 89 (FIGS. 3B, 3C, & 3D) that turn freely and independently along with the roller so as to enhance the free and easy movement of the chain over the roller and through the assembly. This containment or entrapment of the mechanism chain traveling roller assembly 60 is clearly visible in FIG. 4A which shows the side plates 64 of the mechanism chain traveling roller assembly 60 constrained by the guide posts 70. The links of the chain by the nature and intent of the chain design, virtually hug the roller, these links laying almost at 45 degree angles to the roller surface and each subsequent link laying contra to its preceding link thus allows the chain to conform closely to the radius of the roller that it ensures that the chain does not get hung up or twisted or contorted as the chain or the links pass through the roller assembly(ies). This same concern is addressed when using cable or other flexible components in lieu of chain. The mechanism chain roller assembly 60 does not rotate in combination with the lead screw 32. Instead, it tracks up and down the lead screw 32 thus reeling in or reeling out the chain 21. Therefore, the mechanism chain traveling roller assembly 60 enables twice the amount of chain to be reeled out or reeled in across the pathway/driveway as the assembly travels inside the post. For every foot the mechanism chain traveling roller assembly 60 moves along the lead screw 32, two feet are reeled out or reeled in, thus allowing the mechanical advantage of twice the barrier length per the height of the posts. Specifically, as the mechanism chain traveling roller assembly 60 moves one foot up the lead screw 32 it lets out the one foot of chain between the securing anchor clamp bracket 24 and the mechanism chain traveling roller assembly 60 plus one foot of chain between the mechanism chain traveling roller assembly 60 and the external roller 72. For purposes of covering still greater widths of driveways, this mechanical advantage may be increased on other embodiments by adding additional rollers to the lead screw upper chassis plate and the mechanism chain traveling roller assembly 60.

Figure 5:
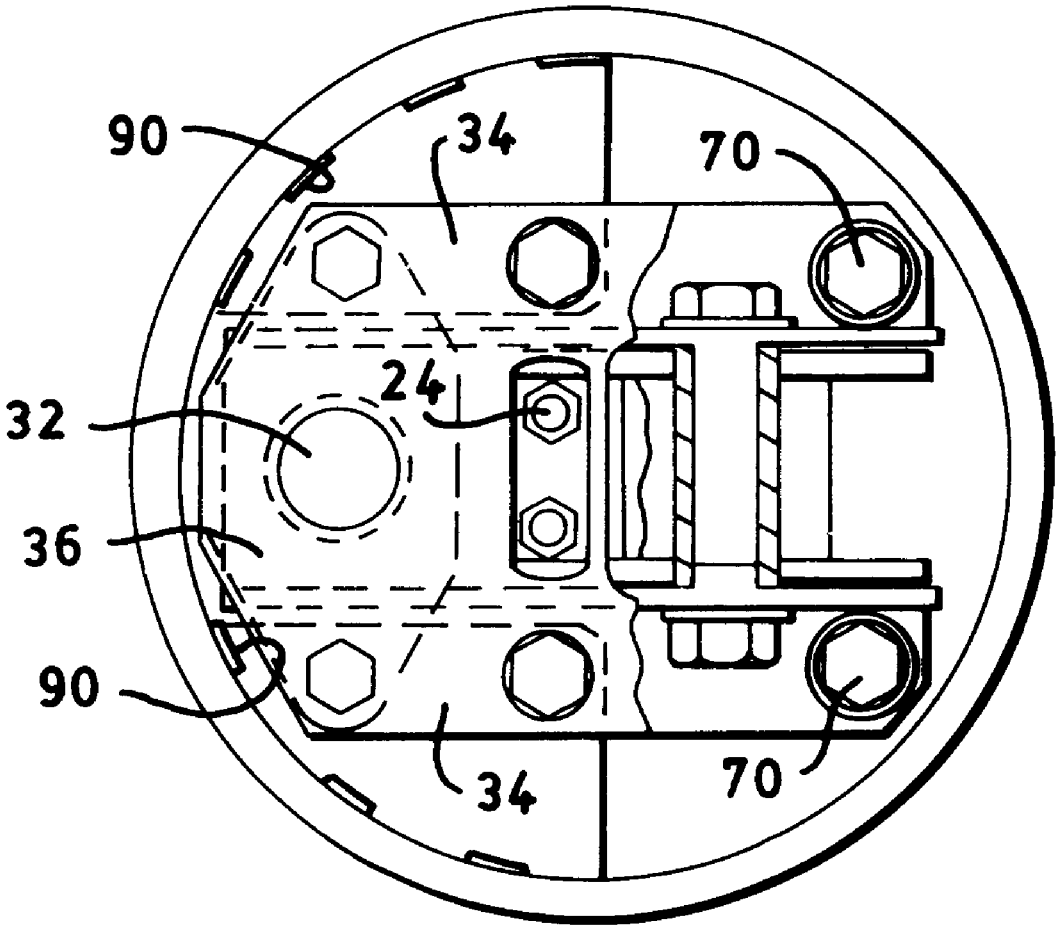
FIG. 5 is a top view showing one embodiment of an operating chassis top plate assembly of the modular removable framework which supports most of the components of the mechanism.

The lead screw 32 is driven by means of a motor 80 (FIGS. 2A & 2C) comprising an output shaft 83 onto which is attached a gear 84 which in turn drives a planetary, or with an alternative embodiment an "offset" gear 37 connected to the lead screw 32 (FIGS. 2A compared with 2C). The lead screw 32 is secured into place by means of a bearing 36 which is bolted to a mechanism chassis assembly 34 (FIGS. 2A,2C & 5) so that it will maintain a precise positioning for the lead screw 32. The mechanism base plate 40 (FIGS. 2A & 2F) serves (essentially) the same purpose and function as the mechanism chassis assembly 34 but is attached to the bottom of the lead screw 32. The combination of mechanism chassis assembly 34 and mechanism base plate 40 along with the support and guide bars 70 keeps the lead screw in perfect alignment. The lead screw 32 bottom bearing and its anchor bolts 42 are attached to the base plate 40 (FIG. 2A) along with the mechanism chain traveling roller assembly guide posts 70 (FIGS. 2A & 2F). Other anchor bolts (not shown) secure the mechanism top chassis assembly plate 34 to the anchor plate 35 welded to the post that secures the complete modular mechanism frame assembly to the posts. (FIGS. 2A, 2B, 5).

In another embodiment, the motor 80 is supported by a motor chassis 82 and standoff assembly 85 (FIG. 2C) which suspends the motor 80 above the mechanism chassis assembly 34 and allows for a space for the planetary (or offset) gear 37 and drive gear 84 to engage one another. These standoffs 85 consist of three independent steel round bars and spacers (FIG. 2C) bolted to both the motor chassis 82 and the mechanism chassis assembly 34. Together these components reel in and reel out a chain 21 which in turn raises and lowers the flexible barrier.

A circuit board (not shown) can be contained inside the stationary object or, alternatively, can be placed outside. In any event, the circuit board contains the circuitry (available commercially) needed to receive a remote control signal and activate or deactivate the motor 80. This circuitry is of a conventional type and can be purchased commercially or designed by one reasonably skilled in the art in order to control the motor and receive signals from the switches and the remote control. By using this approach, the barrier can be raised and lowered into position by pressing the operating button on the remote control device (not shown). The motor 80 is turned on and begins to operate the lead screw.

Figure 3A:
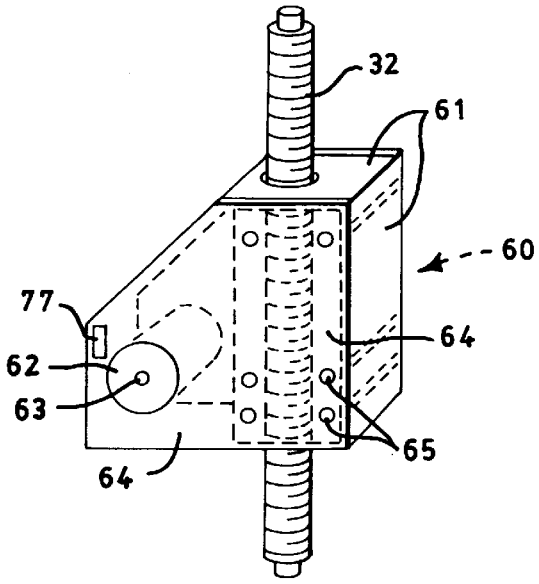
FIG. 3A is a perspective view showing the details of one embodiment of a mechanism chain traveling roller assembly. In addition.
Figure 3B:
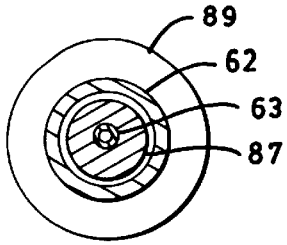
FIG. 3B depicts an end view of the internal axle roller while FIG. 3C displays a cross-sectional view of same.
Figure 3C:
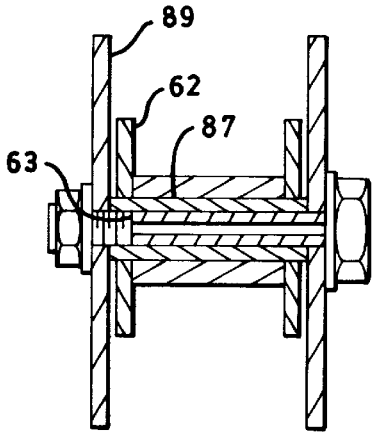
FIG. 3D is a more detailed side view and front view of the mechanism chain traveling roller assembly of one embodiment of FIG. 3A.
Figure 3D:
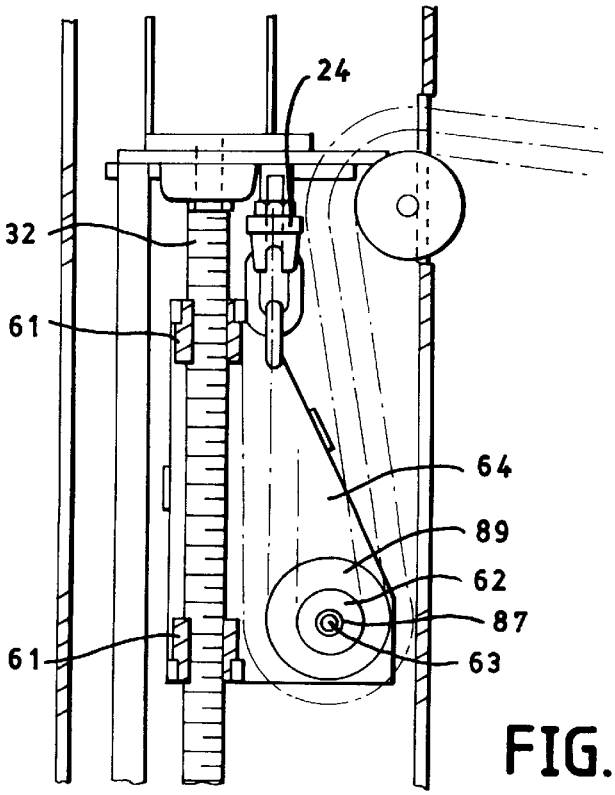
Figure 4A:
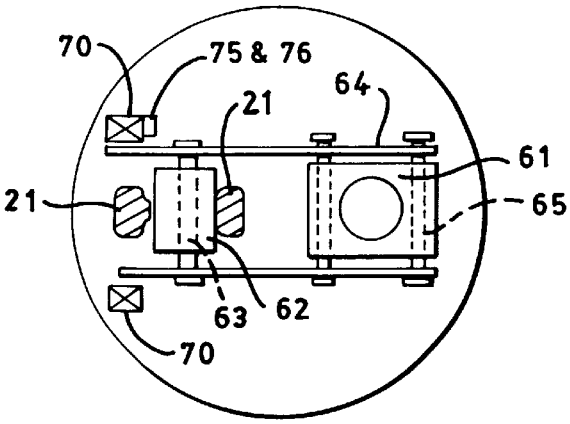
FIG. 4A is a top view of the embodiment of a mechanism chain traveling roller assembly shown in FIG. 3. In addition, FIG. 4B provides detail for the limit switches.
Figure 4B:
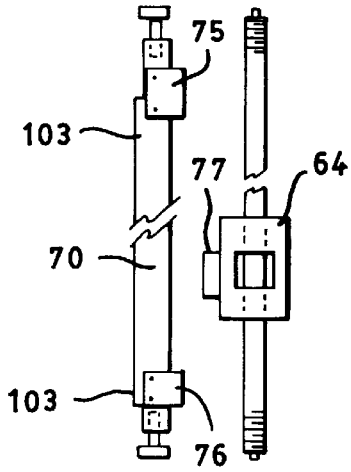
FIGS. 4C & 4D provide a more detailed view of the relationship between the magnet 77 and the mechanism chain travelling roller assembly 60.

FIGS. 3A & 3D show the details of the mechanism chain traveling roller assembly 60 which is comprised of two side plates 64 secured to an elongated threaded traveling nut 61 by means of assembly chassis bolts 65 (FIG. 4A). The traveling nuts 61 consist of a top nut and a lower nut (FIG. 3D). The mechanism chain traveling roller assembly 60 then supports the internal roller 62 by means of the internal roller axle 63 and spacer 87. Traveling around the internal roller 62 is the chain 21. (FIG. 3D)

Figure 4C:
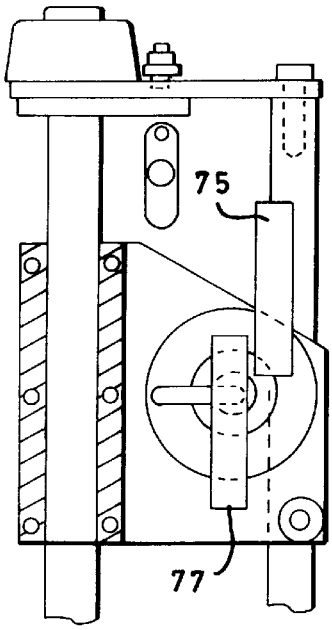
Figure 4D:
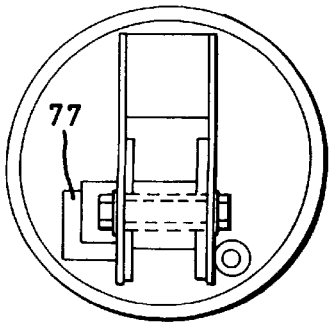

The movement of the mechanism chain traveling roller assembly 60 is controlled by means of top and bottom limit switches 75 & 76 (FIGS. 4A, 4B, & 4C) secured to the roller assembly guide posts 70 in such a positioning that when interacting with magnet 77 on the side plate 64 of the mechanism chain traveling roller assembly 60, a signal is communicated by means of hard wires 103 (FIG. 4B) to the electronic control panel (not shown) to tell the motor to stop and then reset itself to wait for a next signal from a remote control device (not shown) which will direct the mechanism chain traveling roller assembly 60 to again move, but in the opposite direction. This simple electronic control switch design is common knowledge to anyone versed in the art of remote control electronics.

The source of energy to the electronic control panel and motor 80 can be either by a 6, 12 or 24 volt battery or by standard 110 AC current. If a battery is used it may be recharged by means of solar, wind or hydrogeneration, hard wired to the battery.

The posts can be decorated with an ornamental or architectural designs such as various light fixtures, or heads of animals, fowls, or other design structures, which can be attached to the tops of the posts and can be changed according to the season of the year and the whim of the user. Lighting fixtures can also be attached to the top of the posts. The posts can be made out of steel, round or square, turned wood, aluminum, cast metal, concrete or any other suitable material. This chain gate structure can also be adapted to be used with existing posts, columns or other structures by drilling a horizontal hole through the post, column, wall, or structure and extending the flexible barrier through the hole to the mechanism sitting inside the column or wall on the backside of the column or wall. The posts can also be equipped with any one of the numerous commercial intercom systems (or camera systems) which will allow a person wishing to pass through the gate to communicate with a person at a remote location having the power to raise and lower the gate. The visitor will drive up to the gate and push the intercom button, keypad, or such means causing a buzzer or other means of notification to go off in the owner's house or a factory's office. The owner can then turn on the intercom and communicate with the visitor and decide if the chain structure should be lowered for the visitor. If the owner decides to let the visitor in, the owner can push a control button that is direct wired from the gate into the house or the owner can use the remote control to lower the gate. After the visitor passes through the gate, the owner can raise the gate again or the gate can be set to automatically raise after a set period of time has elapsed after lowering or by sensing the completion of passage through the gate. Any known sensing device can be used to sense the completion of passage through the gate. Representative examples of these sensor devices include, but are not limited to, combination keypads, card readers, voice, sound, and print mechanisms.

In one embodiment of the chain gate several manual override arrangements are available which will allow the user to lower the gate and pass through when there has been a power outage or the battery has completely discharged. One manual override is a separate and independent auto battery which can be used to lower the barrier when the manual override switch is pressed. This can be hooked up via jumper cables to jump studs designed into the product or attached to the control board, both of which will provide power to operate the gate when the product battery is drained. Another manual override is a padlock in the non-winding mechanism pole whereby a gate owner can open the top cap and unlock a padlock connected to a chain link on the inside of the post.

Various modifications may be made to the preferred embodiment of the present invention without departing from the spirit and scope of the invention as defined by the appended claims. For example, a protruding crank can be linked to the lead screw 32 after removing the motor in order to operate the device by hand.

This invention offers numerous embodiments designed for applications and uses accommodating not only typical residential and commercial driveways but also the elevated height requirements found at rural properties, livestock pens, and factory entrances.

One skilled in the art can modify this invention into many different embodiments. For example, consider the following three specific embodiments.

Figure 6:
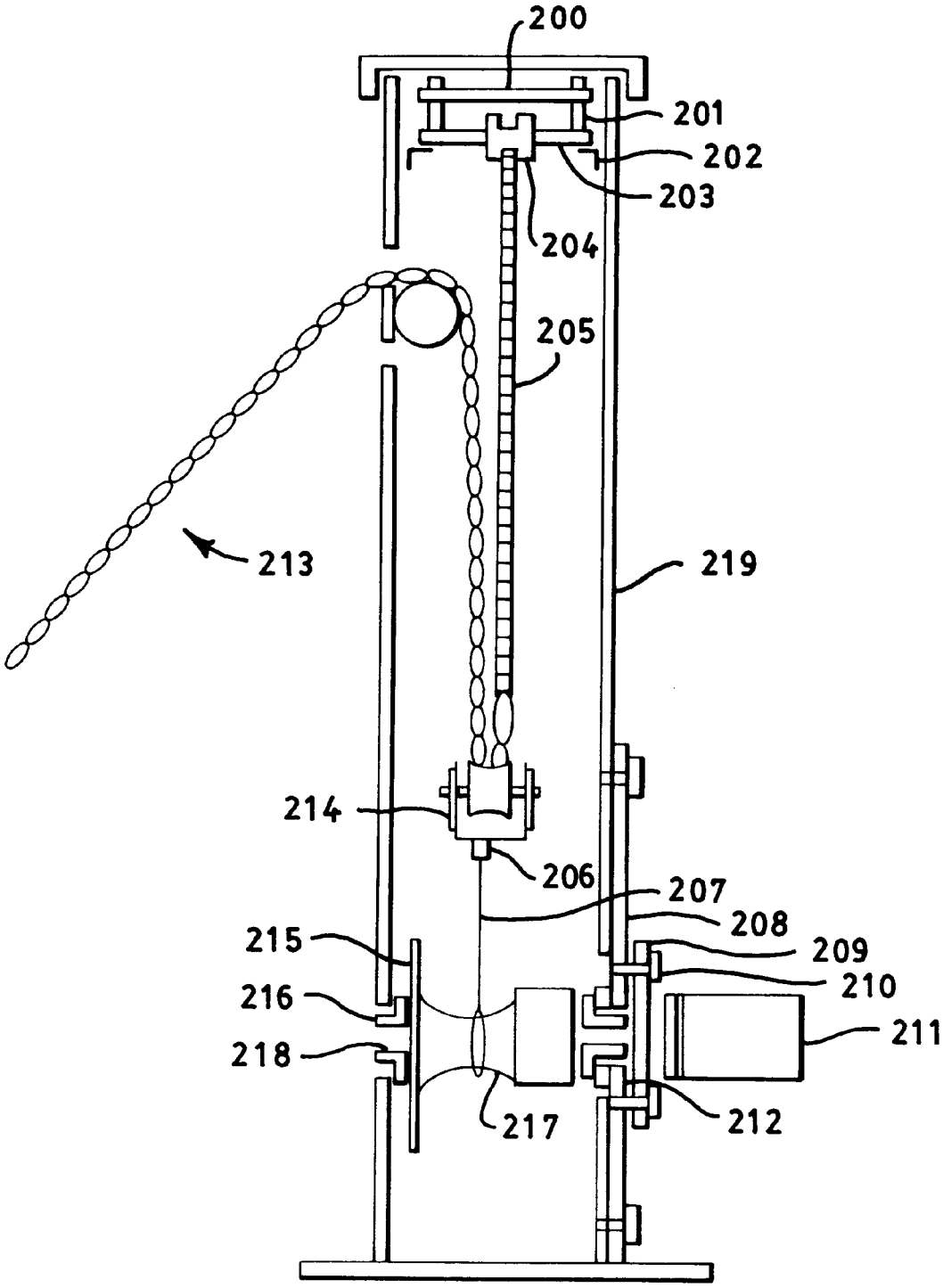
FIG. 6 represents one embodiment in which the internal mechanism is simplified to a single chain and travelling roller assembly supported by the top plate.

FIG. 6 shows one embodiment, in which the invention is simplified to a single internal chain 205 and travelling roller assembly 214 supported by the top chain support plate 203. The motor 211 is at the bottom of the invention and directly linked to a spool 217 which by means of a flexible material 207 reels in and out the traveling roller assembly 214 (* in FIG. 6 indicates part is rotated 90° from actual) that actively raises the flexible barrier 213 in the same fashion as the preceeding embodiment (FIG. 2). The internal chain 205 is connected to the top chain support plate 203 by a chain anchor 204 that is affixed to post 219 by weldmounts 202. The computer board 200 is supported above the chain support plate 203 by standoffs 201 that control the operation of the motor 211 that is mounted to the post 219 by means of the post mounting plate 208 and motor mounting plate 209. The traveling roller assembly 214 is connected to the spool 217 by a connecting cable 207 and swivel connector 206 that rotates around the shaft 218. The motor 211 drives shaft 218 by means of gear box 210 that is held in place by bearings 212, 216 and the revolution sprocket wheel 215. As the spool 217 rotates the traveling roller assembly 214 is raised or lowered resulting in the raising or lowering of the flexible barrier 213.

Figure 7:
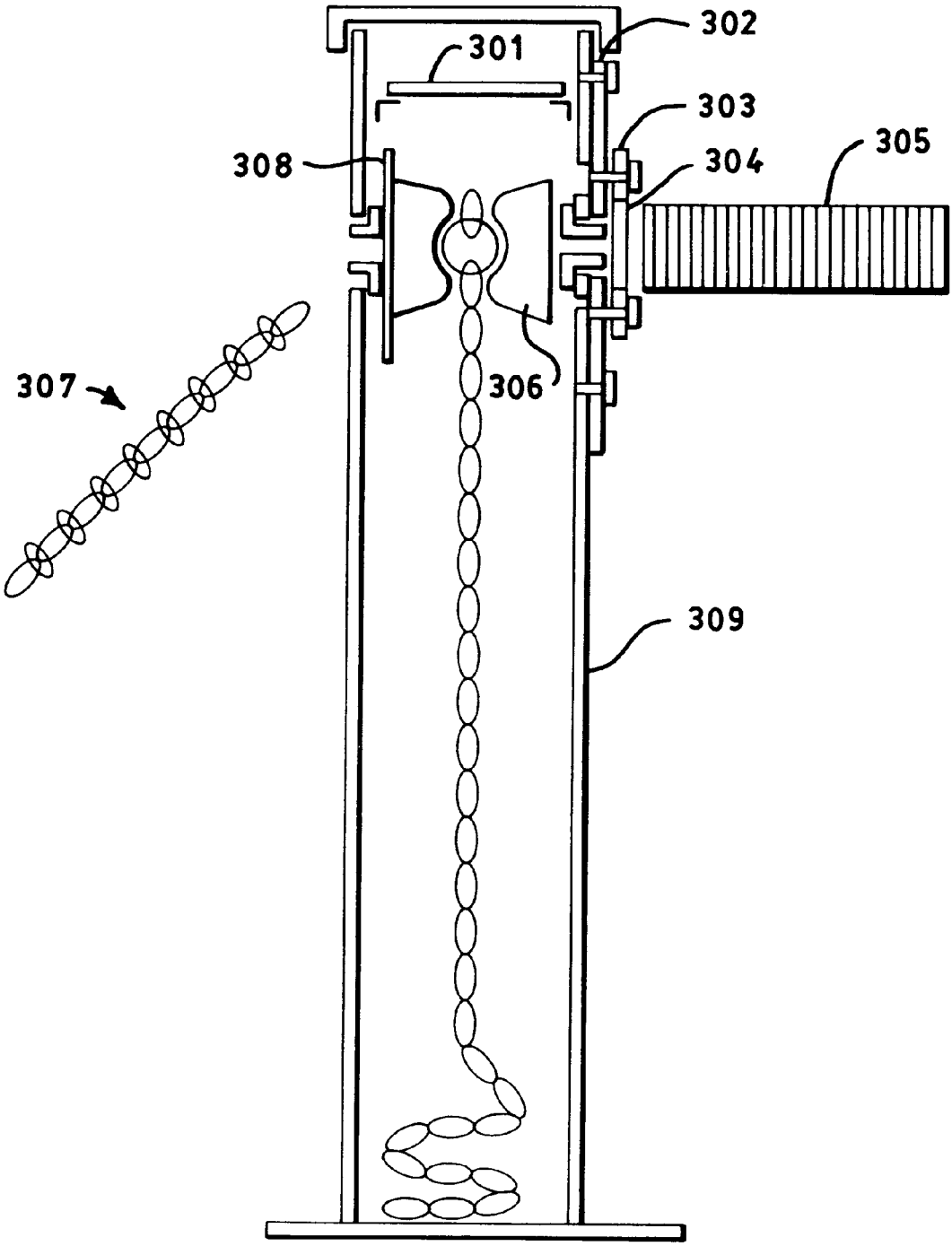
FIG. 7 represents one embodiment in which the motor at the top of the invention is directly linked to a revolution sprocket wheel.

FIG. 7 shows a second alternative embodiment. The motor 305 is located at the top of the invention and is directly linked to a windlass knobbed spool 306 by means of gear box 304 that actively raises and lowers the flexible barrier 307 and allows the excess barrier to drop freely to the bottom of post 309. The motor 305 and gear box 304 are supported by the mounting flange 303 and affixed to post 309 by means of the motor assembly chassis plate 302. Also attached to the post 309 is the circuit board 301 that controls the operation of the motor 305. In this case, the flexible barrier 307 is directly raised and lowered only by the rotation of the windless spool knob 306 without any secondary pulleys or gears.

Figure 8:
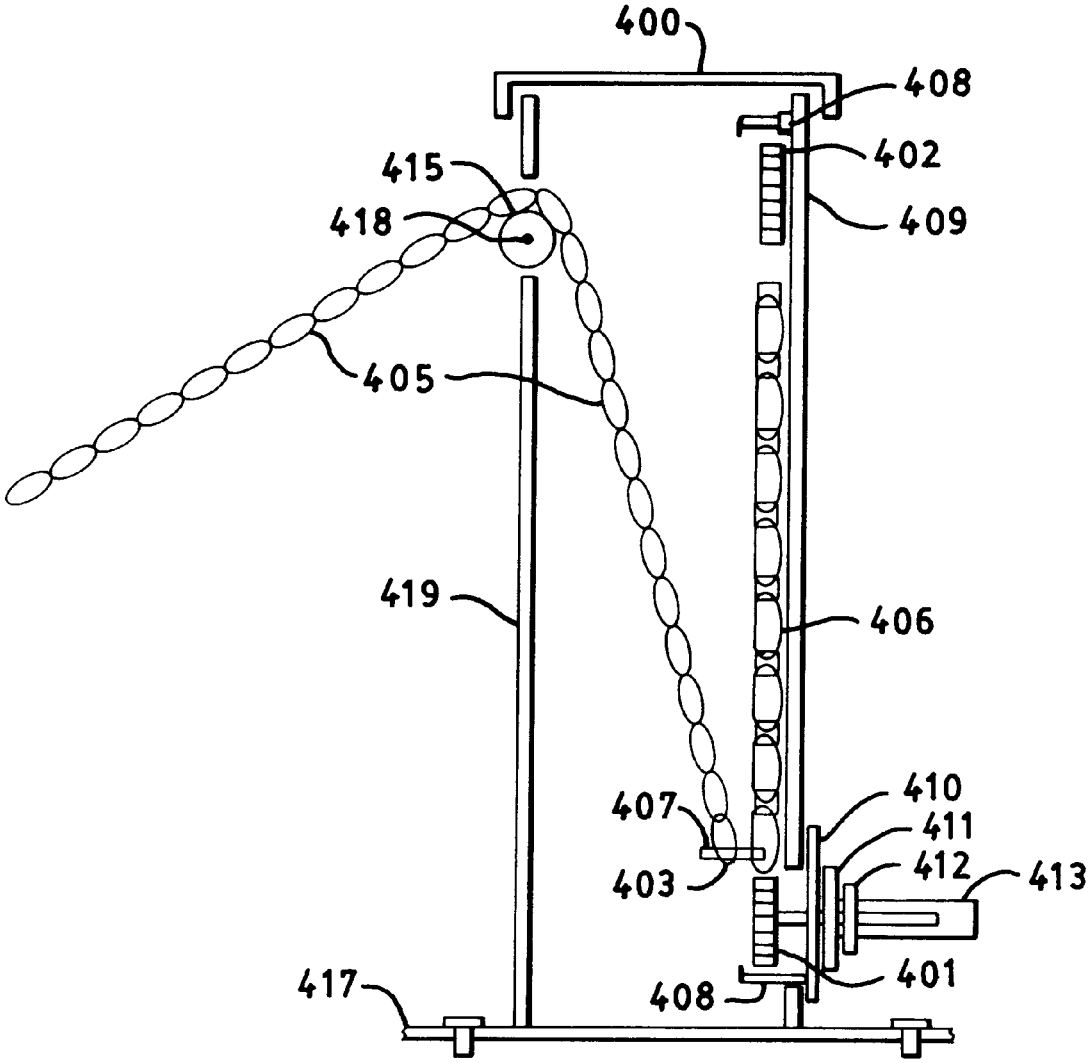
FIG. 8 represents one embodiment in which the chain revolves as a single loop.

In the third alternative embodiment (FIG. 8), the internal chain 406 revolves around and between the upper idler sprocket 402, supported by idler axle stud 409, and lower motor-driven sprocket 401. The chain connector 403 rotates in one continuous direction, carrying with it the connection to the external chain 405. The external chain 405 is reeled in and out of the supporting structure 416 by means of the external roller 415 and external roller axle 418 resulting from the rotation of the lower motor-driven sprocket 401 driven by motor 413 and gear box 412. The motor 413 and gear box 412 are mounted to the post 419 by means of flanged motor mounting plate 411 and flanged assembly mounting plate 410. As the chain connector 403 rotates to the upper position at the idler sprocket 402, the external chain 405 is reeled out thus relaxing the chain into its down position where passage is possible. When the chain connector 403 rotates to the lower sprocket 401, always traveling in the same direction, it pulls with it the external chain 405, reeling in and tightening the external chain 405 so as to prevent passage when the external chain 405 is in the final up position. The post 419 is attached to the ground by means of the flanged base plate 417 and sealed at the top by cap 400. This version simplifies the invention in numerous ways: (a) fewer parts, (b) simpler manufacturing, (c) easier repair, (d) fewer and simpler electronic logic boards since the motor operates only in one direction with only one traveling limit switch tripper 407 which is a magnet positioned on the internal chain 406 connector 403 so that as it passes by limit switches 408, the chain 406 stops, thereby locking external chain 405 into its desired position. When either wsitch 408 is tripped, the motor stops and waits for the next remote controlled signal to activate the motor to move the travelling tripper 407 to the next position. All of the above features contribute to making the present invention a far more economical and less expensive product concept.

From the above, it should be clear that the present invention offers high reliability at a low cost and low selling price, thus having considerable benefit for the public interest. Additionally, the assemblies are easily removed from the external structure, exposing all of the attached components and providing easy access to each of them for purposes of repairing or replacing parts.

We claim:

1. A barrier system comprising:

a) a barrier linking a first stationary object to a second stationary object, b) a means for raising and lowering said barrier, said means coupled to said barrier and comprising;

i) a lead screw;

ii) a motor operably linked to said lead screw such that said lead screw turns when said motor operates, and iii) a traveling roller assembly configured such that it moves up and down said lead screw when said lead screw turns, said traveling roller assembly comprising an internal roller that engages said barrier.

2. The barrier system of claim 1, wherein said means for raising and lowering said barrier is enclosed within said first stationary object.

3. The barrier system of claim 2, wherein said first stationary object comprises a hollow object selected from the group consisting of a post, column, pillar, and wall.

4. The barrier system of claim 3, wherein said lead screw has top and bottom ends, said bottom end secured to a base plate mounted within said post, and said top end secured to an integral top plate.

5. The barrier system of claim 1, wherein said traveling roller assembly slidably engages a guide, said guide configured such that said roller assembly is prevented from turning when said lead screw turns.

6. The barrier system of claim 1, wherein said motor comprises an output shaft and said motor is operably linked to said lead screw through one or more gears engaging said output shaft.

7. The barrier system of claim 1, wherein said barrier comprises a chain which hangs between said first stationary object and said second stationary object.

8. The barrier system of claim 1, wherein said barrier comprises a system of additional pulleys and longer chain lengths providing elevated barrier heights or longer spanned distances.

9. A barrier system comprising:

a) a barrier linking a first stationary object to a second stationary object, b) a mechanism for raising and lowering said barrier, said mechanism enclosed within said first stationary object and coupled to said barrier, said mechanism comprising;

i) a lead screw, ii) a motor operably linked to said lead screw such that said lead screw turns when said motor operates, and iii) a traveling roller assembly configured such that it moves up and down said lead screw when said lead screw turns, said traveling roller assembly comprising an internal roller that engages said barrier.

10. The barrier system of claim 9, wherein said first stationary object comprises a hollow object selected from the group consisting of a post, column, pillar, and wall.

11. The barrier system of claim 10, wherein said lead screw has top and bottom ends and said bottom end is secured to a base plate mounted within said post.

12. The barrier system of claim 9, wherein said traveling roller assembly slidably engages a guide, said guide configured such that said roller assembly is prevented from turning when said lead screw turns.

13. The barrier system of claim 9, wherein said motor comprises an output shaft and said motor is operably linked to said lead screw through one or more gears engaging said output shaft.

14. The barrier system of claim 9, wherein said barrier comprises a chain which hangs between said first stationary object and said second stationary object.

15. The barrier system of claim 9, wherein said barrier comprises a system of additional pulleys and longer chain lengths providing elevated barrier heights or longer spanned distances.

16. A barrier system comprising:

a) a barrier linking a first stationary object to a second stationary object, b) a barrier raising and lowering mechanism, said mechanism enclosed within said first stationary object and coupled to said barrier, said mechanism comprising;

i) a lead screw, ii) a motor operably linked to said lead screw such that said lead screw turns when said motor operates, iii) a traveling roller assembly configured such that it moves up and down said lead screw when said lead screw turns, said traveling roller assembly comprising an internal roller that engages said barrier, and iv) a guide configured such that said roller assembly is prevented from turning when said lead screw turns, said guide slidably engaging said traveling roller assembly.

17. The barrier system of claim 16, wherein said first stationary object comprises a hollow object selected from the group consisting of a post, column, pillar, and wall.

18. The barrier system of claim 17, wherein said lead screw has top and bottom ends and said bottom end is secured to a base plate mounted within said post.

19. The barrier system of claim 16, wherein said motor comprises an output shaft and said motor is operably linked to said lead screw through one or more gears engaging said output shaft.

20. The barrier system of claim 16, wherein said barrier comprises a chain which hangs between said first stationary object and said second stationary object.

21. The barrier system of claim 16, wherein said barrier comprises a system of additional pulleys and longer chain lengths providing elevated barrier heights, or longer spanned distances.

* * * * *